US005967105A

United States Patent [19]

Freeland

[11] Patent Number: 5,967,105

[45] Date of Patent: Oct. 19, 1999

[54] HYDRAULIC LASH ADJUSTER WITH AN OPEN ENDED TOP PLUNGER SURFACE

[75] Inventor: Mark Freeland, Farmington Hills, Mich.

[73] Assignee: Ford Global Technologies, Inc., Dearborn, Mich.

[21] Appl. No.: 09/138,738

[22] Filed: Aug. 24, 1998

[51] Int. Cl.[6] ..... F01L 1/24

[52] U.S. Cl. ..... 123/90.43; 123/90.36; 123/90.57

[58] Field of Search ..... 123/90.35, 90.36, 123/90.39, 90.41, 90.43, 90.46, 90.55, 90.56, 90.57

[56] References Cited

U.S. PATENT DOCUMENTS

| | | |
|---|---|---|
| 3,273,548 | 9/1966 | Hoffman . |
| 3,587,539 | 6/1971 | Dadd . |
| 3,799,129 | 3/1974 | Cornell . |
| 3,805,753 | 4/1974 | Bergmann . |
| 4,004,558 | 1/1977 | Scheibe . |
| 4,098,240 | 7/1978 | Abell . |
| 4,438,739 | 3/1984 | Arai . |
| 4,462,364 | 7/1984 | Kodama . |
| 4,481,913 | 11/1984 | Wirth . |
| 4,589,383 | 5/1986 | Showalter . |
| 4,596,213 | 6/1986 | Hillebrand . |
| 4,633,827 | 1/1987 | Buente . |
| 4,807,576 | 2/1989 | Sonoda . |
| 4,840,153 | 6/1989 | Aida . |
| 5,398,648 | 3/1995 | Spath . |
| 5,622,147 | 4/1997 | Edelmayer . |
| 5,660,153 | 8/1997 | Hampton . |

*Primary Examiner*—Weilun Lo
*Attorney, Agent, or Firm*—Roger May; Jerome Drouillard

[57] ABSTRACT

A hydraulic lash adjuster mechanism for an internal combustion engine having a body portion with a bore formed in the body portion having a bottom surface. A plunger having a top surface is slidingly received within the bore of the body portion. The plunger has an internal channel with a bleed hole formed therein connecting the top surface of the plunger to a high pressure chamber formed between the bottom surface of the bore and the bottom of the plunger. The body portion has a valve opening formed therein that is in fluid communication with an engine fluid supply. A check valve mechanism selectively opens and closing the valve opening in response to pressure differences between the engine fluid reservoir and the high pressure chamber. The diameter and length of the bleed hole and the force applied to said top surface of said plunger control the leak down rate of the hydraulic lash adjuster to eliminate lash in the engine valve train components.

17 Claims, 2 Drawing Sheets

20
22
58
70
62
61
56
18
80
10
54
32
14
26
24
52
50
44
30
48
46
42
40
34
16
28
12

20
22
58
70
62
61
56
18
80
54
10
32
14
26
24
52
50
44
48
30
46
42
40
16
34
28
12

HYDRAULIC LASH ADJUSTER WITH AN OPEN ENDED TOP PLUNGER SURFACE

TECHNICAL FIELD

The present invention relates generally to hydraulic lash adjusters. More specifically, the present invention relates to hydraulic lash adjuster mechanism for internal combustion engines having a bleed hole formed through the top surface of the plunger allowing the leak down rate to vary under a full range of operating conditions.

BACKGROUND

Hydraulic lash adjusters are well known for use in internal combustion engines. Lash adjusters are typically used to eliminate clearance or lash between engine valve train components that can result from varying operating conditions. Hydraulic lash adjusters are used to maintain engine efficiency, to reduce engine noise, and minimize wear on the valve train.

Hydraulic lash adjusters operate by transmitting the energy of a valve actuating cam through hydraulic fluid trapped in a pressure chamber beneath a plunger in the lash adjuster body. During each operation of the cam, as the length of the valve actuating components vary (due to temperature changes, for example), small quantities of hydraulic fluid are permitted to enter or escape from the pressure chamber. As the hydraulic fluid enters or escapes the pressure chamber (leak down), the position of the plunger is adjusted and consequently the effective total length of the valve train is adjusted which minimizes or eliminates the lash.

Conventional hydraulic lash adjusters have a leak down rate controlled by precise clearance between two concentric tubes, namely, the plunger and the outer cylinder, such as disclosed in U.S. Pat. No. 5,622,147. The leak down rate is controlled by a leak path located between the outer periphery of the plunger and the inner wall of the lash adjuster body. Since the leak down rate of these prior lash adjusters depends on the magnitude of the gap between the two concentric tubes raised to the third power, slight changes in dimensions can have a large effect on the leak down rate. As a result, these tubes typically are provided with a lapped or polished finish and are matched to provide a leak path of the appropriate dimensions to ensure the required accuracy in leak down rate. The process used to provide tubes with these precise dimensions in order to achieve the desired accuracy is an expensive process.

To properly minimize lash, the leak down rate must be sufficiently fast so that as the engine valve heats and expands, the lash adjuster can relax and accommodate the expansion. If the lash adjuster does not accommodate the engine valve expansion, the engine valve may not seat completely. The inability of a lash adjuster to accommodate engine valve expansion could potentially cause engine problems such as loss of power output and deposit buildup on the engine valve stem. These problems can be exacerbated with new engine designs that heat the catalyst more rapidly causing the engine exhaust valves to also quickly heat and expand.

While hydraulic lash adjusters typically can increase their length quickly, they require more time to shrink, which is a function of the oil viscosity and temperature. For example, as the engine's oil gets cooler and more viscous, the leak down rate decreases. However, the engine valve train growth rate is at its maximum during the initial warm up from a cold start. Thus, only the minimum leak down rate is available at the time the maximum leak down rate is required. Current lash adjusters are unable to provide the required leak down rate during the initial warm up from a cold start.

Similarly, a leak down rate that is too fast can cause a hydraulic lash adjuster to relax sufficiently during a single cycle causing the cam follower to lose contact with the cam. Under this circumstance, the engine valve could potentially slam shut, causing noise which is most evident under hot idle conditions. Since the leak down rate varies with engine fluid viscosity, both the grade of engine fluid used and the temperature will affect the leak down rate, with the result that there may not be a single leak down rate setting that is satisfactory under all conditions. For example, as the engine's oil gets hotter and less viscous, the leak down rate increases. However, the engine valve train growth rate is at its minimum during hot running conditions. Thus, the maximum leak down rate is available at the time the minimum leak down rate is required. Therefore, the current lash adjuster mechanisms do not adequately compensate for lash under all engine parameters and conditions.

SUMMARY OF THE INVENTION

The present invention is directed to overcoming one or more of the problems as set forth above. It is an object of the present invention to provide a lash adjuster with variable leak down rates to accommodate rapid engine valve stem growth, such as experienced during a fast warm up from a cold start.

It is yet another object of the present invention to provide a lash adjuster mechanism for minimizing engine valve lash during virtually all engine conditions.

According to the present invention, the foregoing and other objects are attained by providing an improved hydraulic lash adjuster for an internal combustion engine. The lash adjuster has a body portion having a bore formed therein that terminates at a bottom surface. A plunger having a top surface is slidingly received within the bore. The plunger top surface has a bleed hole formed through it. A high pressure chamber is formed in the body portion between the bottom surface of the bore and the bottom of the plunger. The body portion has a valve opening formed therein that is in communication with an engine fluid supply apart from the lash adjuster. The valve opening is in communication with a check valve mechanism that selectively opens and closes the valve opening in response to pressure differences between the engine fluid supply and the high pressure chamber.

The top surface of the plunger is in communication with a cam follower. The cam follower has a cup formed therein that communicates with the bleed hole. As more force is applied to the cam follower, the engine fluid film thickness between the cup and the plunger ball end reduces and slows down the leak rate. The leak rate is thus controlled by the diameter of the bleed hole and the force applied to the top surface of the plunger.

Additional objects and features of the present invention will become apparent upon review of the drawings and accompanying detailed description of the preferred embodiments.

DESCRIPTION OF THE PREFERRED EMBODIMENT

Figure 1:
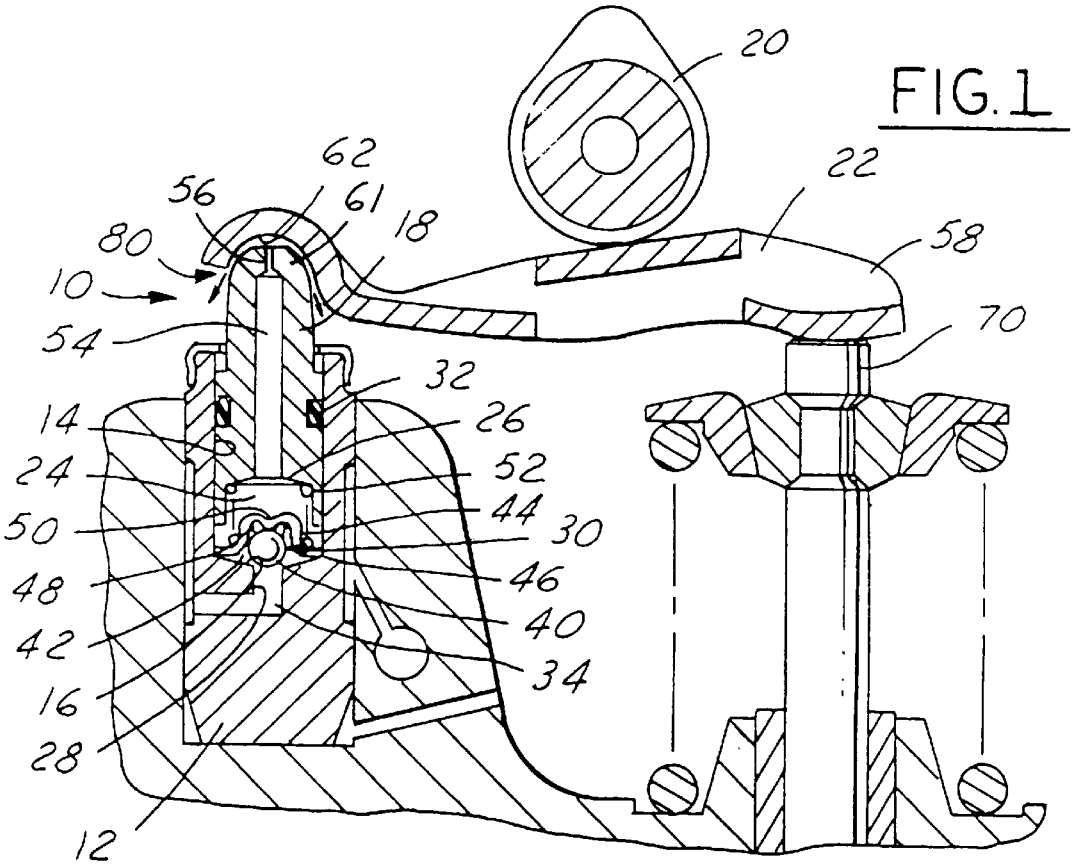
FIG. 1 is a cross-sectional illustration of a lash adjuster, when the engine valve is in a closed position and the ball check valve is in the open position, with a bleed hole formed in the top of the plunger in accordance with a preferred embodiment of the present invention.
Figure 2:
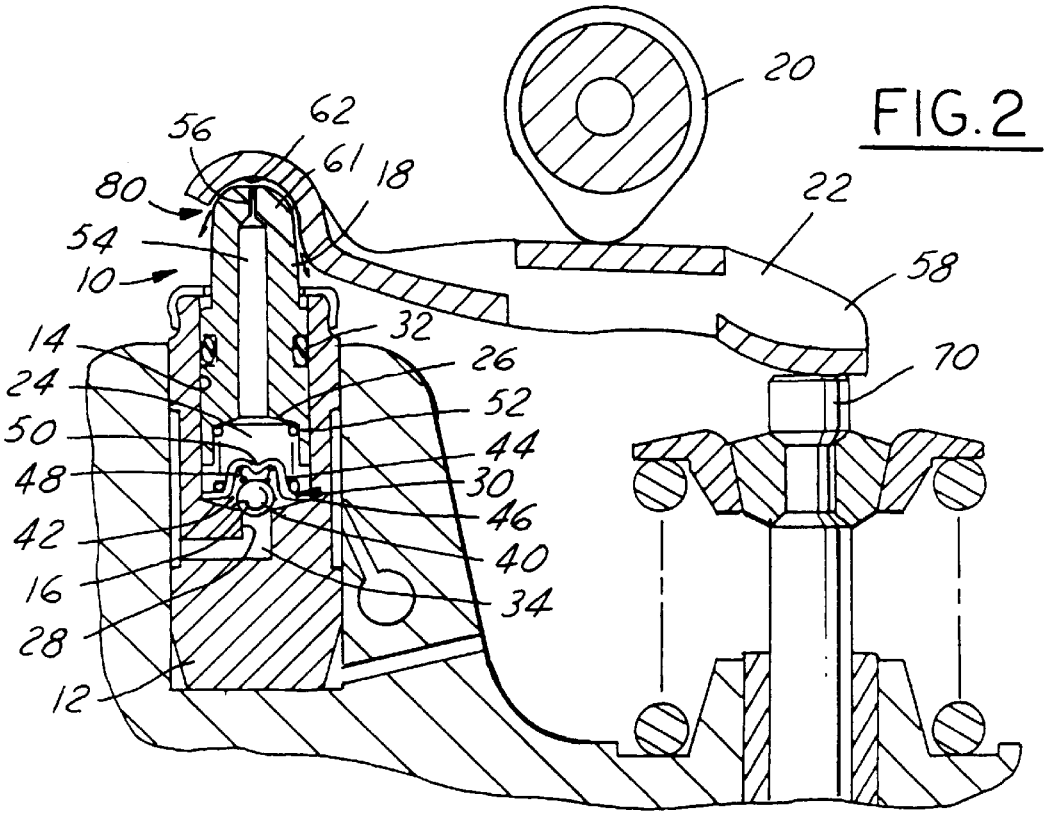
FIG. 2 is a cross-sectional illustration of a lash adjuster, when the engine valve is in an open position and the ball check valve is in the closed position, with a bleed hole formed in the top of the plunger in accordance with a preferred embodiment of the present invention.
Figure 3:
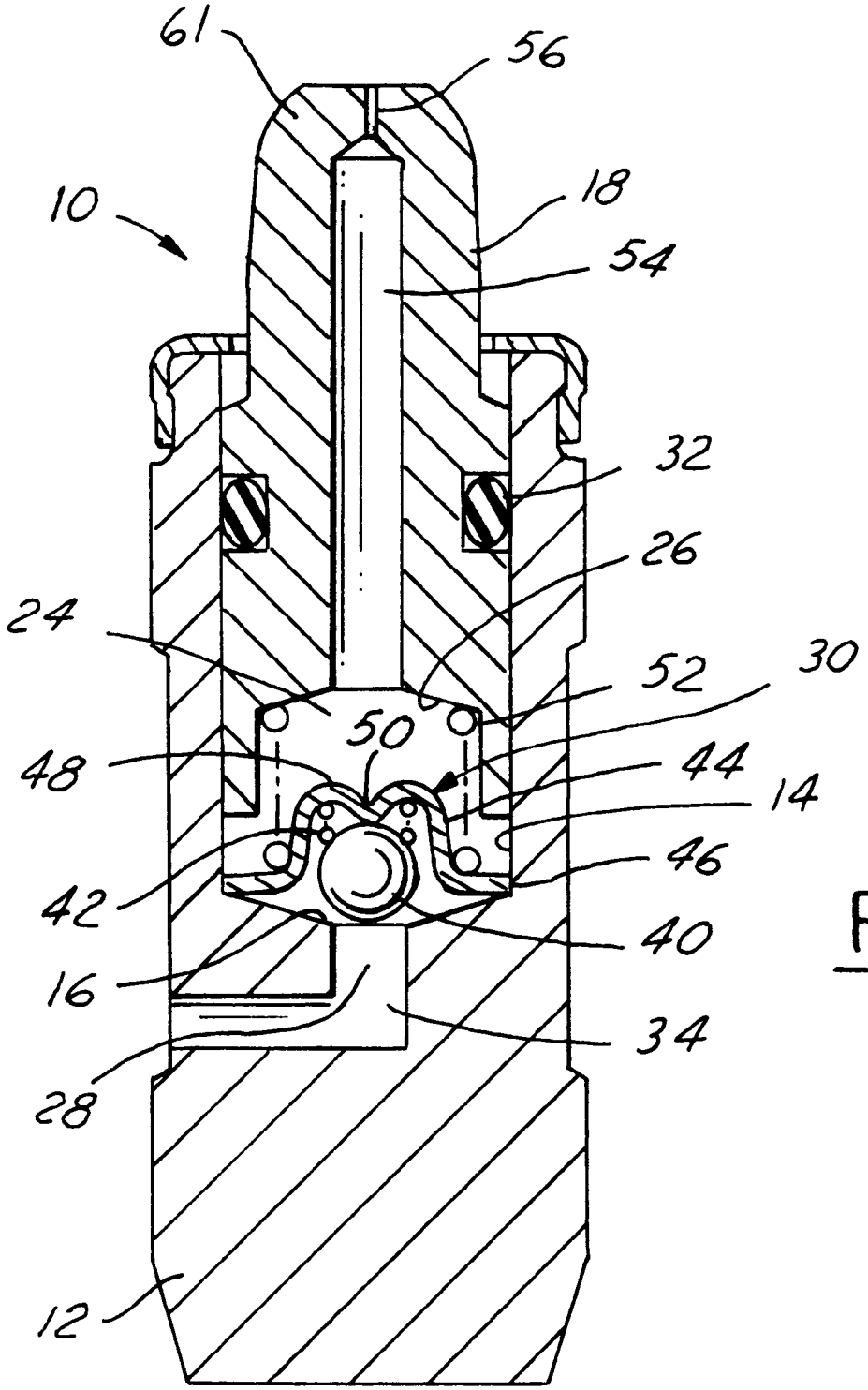
FIG. 3 is an enlarged cross-sectional illustration of a lash adjuster in accordance with a preferred embodiment of the present invention.

FIGS. 1, 2, and 3 illustrate a preferred embodiment of a lash adjuster in accordance with the present invention. The lash adjuster 10 includes a body member 12 in which a bore 14 is formed therein. The bottom of the bore 14 is defined by a bottom bore surface 16. A plunger 18 is telescopically positioned within the bore 14, such that the plunger 18 can move with respect to the body member 12. The plunger 18 is preferably in communication with a engine valve actuated cam 20 through a cam follower 22 which limits the motion of the plunger 18 away from the bottom bore surface 16.

The plunger 18 has a high pressure chamber 24 formed between its bottom surface 26 and the bottom bore surface 16. The high pressure chamber 24 has a valve opening 28 preferably formed through the bore bottom surface 16. The valve opening 28 is in communication with a check valve 30, preferably a ball valve for selectively opening and closing the valve opening 28. The high pressure chamber 24 is defined by the area between the bottom surface 26 of the plunger 18, the bottom bore surface 16, the inner periphery of the lash adjuster body 12, the periphery of the internal channel 54 in the plunger 18, and the bleed hole 56 in the plunger 18. It should be understood that the high pressure chamber 24 can be positioned in other places and is not limited to the preferred area. For example, the bleed hole 56 may be located at the bottom end of the internal channel 54 in the plunger in which case the internal channel 54 would not form part of the high pressure chamber 24.

The high pressure chamber 24 is preferably sealed at the interface between the lash adjuster body 12 and the plunger 18 by the seal 32. The seal 32 prevents any leakage of engine fluid from the high pressure chamber 24 between the plunger 18 outer surface and the inner periphery of the valve body 12. The seal 32 can be any commercially available seal, including one made out of Teflon or other suitable material. The use of the seal 32 eliminates the need for a precision fit between the plunger and the cylinder, thus reducing manufacturing costs. The use of a seal 32, although preferred, is not necessary to achieve the objects of the present invention.

The high pressure chamber 24 receives an engine fluid, such as oil or the like, which enters the lash adjuster 10 through a fluid passageway 34 and valve opening 28. The fluid passageway 34 receives fluid from the engine's oil galleries. It should be understood that a low pressure reservoir is not required in the disclosed lash adjuster, as the configuration of the disclosed lash adjuster can quickly clear any air which enters the high pressure chamber. This is because of the disclosed flow through design. However, a low pressure reservoir or chamber can be machined into the lower portion of the body member 12 or into the engine cylinder head itself, if a low pressure reservoir is deemed necessary or is desired.

After entering the lash adjuster, the engine fluid passes from the fluid passageway 34 to the valve opening 28. When the check valve 30 is in the position shown in FIG. 2, fluid is prevented from flowing into the high pressure chamber 24. Conversely, when the check valve 30 is in the position shown in FIG. 1, engine fluid flows from the fluid passageway 34 through the valve opening 28 and into the high pressure chamber 24.

The check valve 30 preferably includes a ball valve member 40 that is of a diameter large enough to seal off the valve opening 28. The ball valve member 40 is preferably biased by a first spring member 42 into a closed position wherein the check valve 30 is normally closed and engine fluid is prevented from flowing from the high pressure chamber 24 back through the valve opening 28. The first spring member 42 is maintained in contact with the ball valve member 40 by a platform member 44. The platform member 44 is generally M-shaped in cross-section with a peripheral foot portion 46 and an upper surface 48.

The peripheral foot portion 46 rests on the bottom bore surface 16 while the upper surface 48 lies generally parallel to the bottom bore surface 16 and has an downwardly extending protrusion 50 which limits the travel of the ball valve member 40 with respect to the valve opening 28. A second spring member 52 is interposed between the bottom surface 26 of the plunger and the peripheral foot portion 46. The second spring member 52 maintains the peripheral foot portion 46 and thus the platform member 44 in contact with the bottom bore surface 16.

The high pressure chamber 24 is in fluid communication with an internal channel 54. The internal channel 54 extends between the high pressure chamber 24 and a bleed hole 56. It should be understood that the bleed hole 56 may be located at the top of the internal channel 54, or at the bottom of the internal channel 54 or at any location along the length of the internal channel 54. Alternatively, the bleed hole 56 may extend along the entire length of the internal channel 54. In operation, engine fluid passes from the high pressure chamber 24 through the internal channel 54 and out the bleed hole 56. The rate at which engine fluid passes through the bleed hole is dependent upon a number of factors, including engine fluid viscosity, and the diameter and length of the bleed hole 56 and the oil film thickness between the plunger ball end 61 and the cam follower cup 62.

The cam follower 22 is in communication with an engine valve 70. The cam follower 22 has a cup portion 62 that is separated from the plunger ball end 61 by an engine fluid film 63. The thickness of the engine fluid film 63 regulates the flow of engine fluid from the lash adjuster 10.

In operation, the plunger 18 is moved within the lash adjuster body 12 by the second spring member 52 to extend the plunger 18 and by the engine valve spring 91 to retract the plunger 18. During the engine valve actuation or lift event, the check ball 40 is seated in the valve opening 28 preventing engine fluid from flowing from the fluid passageway 34 to the high pressure chamber 24. At this time, the force from the cam follower 22 is applied to the top of the plunger 18 via the engine fluid film 63 which in turn reduces the fluid film thickness and hence the leak down rate. The higher the force applied by the cam follower 22, the slower the leak down rate.

When the cam is on base circle, the check ball 40 will be unseated from the valve opening 28 when the pressure in the fluid passageway 34 exceeds the pressure in the high pressure chamber 24 by an amount sufficient to overcome the force applied by the first spring member 42. The engine oil gallery pressure and flow through the valve opening 28 combined with the force from the spring 52 will lift the plunger 18 upwardly toward the cam follower 22. Engine fluid will also flow from the high pressure chamber 24, through the internal channel 54, and out the bleed hole 56. The rate of flow is controlled by the pressure in the high pressure chamber, the diameter and length of the bleed hole 56, and by the engine fluid film 63 thickness between the ball end 61 of the plunger 18 and the cup 62 in the cam follower 22.

When a light load is applied to plunger 18 by the cam follower 22, for example, when the first spring member 42 is causing the check valve 30 to almost close off the valve opening 28, the leak down through the bleed hole (FIG. 1) is at its fastest rate. At this point, the engine fluid film 63 thickness between the cup 62 and the plunger ball end 61 is relatively large and engine fluid can leak down as shown by the arrows 80 in FIGS. 1 and 2. The engine fluid that exits the bleed hole 56 falls back into the cylinder head and eventually to the engine sump (not shown). Conversely, when a high force is applied to the plunger 18, for example when the force is at a point to start opening the engine valve 70, the leak down rate will be at its slowest rate. This is because the cup 62 in the cam follower 22 and the ball end 61 of the plunger 18 will be squeezing the engine fluid film 63, thus reducing its thickness and hence increasing the resistance to engine fluid flow through the bleed hole 56.

The diameter and length of the bleed hole 56 control the maximum leak rate, but not the operating leak rate. The operating leak rate is controlled by the engine fluid film thickness between the top surface of the ball end 61 of the plunger 18 and the cup 62 into which it fits. The maximum leak rate controls how fast the lash adjuster will grow. The lower the maximum leak rate, the faster the lash adjuster can grow. The operating leak rate controls how fast the lash adjuster will contract. The faster the leak rate, the faster the lash adjuster will contract. By choosing suitable dimensions, this lash adjuster can be optimized for the desired growth and contraction characteristics. An added benefit of the configuration of the present invention is that any air that is introduced into the high pressure chamber 24 by the engine fluid supply system will bleed out of the high pressure chamber 24 quickly due to the flow through nature of the design.

It should be understood that the leak down rate can be varied. The leak down time of a lash adjuster is proportional to the engine fluid's viscosity, the diameter of the plunger 18, the leak path length, and is inversely proportional to the pressure change across the leak path and the cube of the leak path clearance.

The present invention may be embodied in other specific forms without departing from the spirit or essential attributes thereof; therefore, the illustrated embodiments should be considered in all respects as illustrative and not restrictive, reference being made to the appended claims rather than to the foregoing description to indicate the scope of the invention.

What is claimed is:

1. A hydraulic lash adjuster mechanism for an internal combustion engine comprising:

a body portion;

a bore formed in said body portion and having a bottom surface;

a plunger slidingly received within said bore of said body portion and having a top surface;

a high pressure chamber formed between said bottom surface of said bore and said plunger;

a valve opening in said body portion in communication with an engine fluid supply;

a check valve mechanism for selectively opening or closing said valve opening in response to pressure differences between said engine fluid supply and said high pressure chamber;

a bleed hole formed through said plunger and in communication with said top surface of said plunger;

whereby the diameter and length of said bleed hole and the force applied to said top surface of said plunger control the leak down rate of the hydraulic lash adjuster mechanism.

2. The lash adjuster of claim 1, wherein the said top surface of said plunger is intended to be acted upon by a portion of a cam follower.

3. The lash adjuster of claim 2, wherein said check valve mechanism includes a first ball valve.

4. The lash adjuster of claim 3, wherein said check valve mechanism further includes a housing for said ball valve and a spring member positioned between said housing and said ball valve to urge said ball valve in a normally closed position.

5. The lash adjuster of claim 4, further comprising a second spring member in contact with said plunger bottom surface and said housing to provide an extending force on said plunger.

6. The lash adjuster of claim 1, further comprising a seal preventing engine fluid egress from said high pressure chamber other than through said bleed hole.

7. The lash adjuster of claim 1, wherein when the pressure in said high pressure chamber falls below a predetermined threshold relative to the engine fluid supply pressure, the check valve mechanism will open allowing engine fluid to pass from said engine fluid supply through said valve opening into said high pressure chamber and out said bleed hole.

8. A system for minimizing lash in an engine valve, comprising:

a hydraulic lash adjuster mechanism comprising:

a body portion having a bore formed therein, said bore having a bottom surface;

a plunger slidingly received within said bore, said plunger having a top surface;

a high pressure chamber formed in said body portion;

a valve opening in said body portion permitting engine fluid to flow from an engine fluid supply to said high pressure chamber;

a check valve mechanism for selectively opening or closing said valve opening in response to pressure differences between said engine fluid supply and said high pressure chamber; and a bleed hole formed through said plunger in communication with said top surface of said plunger allowing engine fluid to leak out therethrough;

a cam follower having a first end and a second end, said first end in communication with the engine valve and a second end in communication with said top surface of said plunger;

a cup formed in said second end of said cam follower for communicating with said top surface of said plunger; and a cam for applying variable force to said cam follower and thus varying the engine fluid squeeze film thickness between said cam follower and said plunger and thus varying the leak rate of engine fluid through said bleed hole.

9. The system of claim 8, wherein during the lift event of said engine valve, said check valve mechanism closes said valve opening and said cam follower applies force to the top surface of said plunger to squeeze the engine fluid film, thus reducing its thickness and thus slow down said leak rate.

10. The system of claim 8, wherein when said cam is riding on base circle, said check valve mechanism permits engine fluid to flow through said valve opening and said plunger is forced upward by the engine fluid pressure in said engine fluid supply and engine fluid leaks down through said bleed hole.

11. The system of claim 8, wherein when a light force is applied to said top surface of said plunger by said cam follower, said engine fluid leaks down through said bleed hole at a faster rate then at other cam positions.

12. The system of claim 8, wherein said check valve mechanism comprises a ball valve in communication with said valve opening, a check ball spring biasing said check ball into a position closing off said valve opening, and a check ball cage retaining said check ball spring in contact with said check ball.

13. The system of claim 12, further comprising a plunger spring for biasing said plunger toward said cam follower.

14. A system for minimizing lash in engine valve components of an internal combustion engine, comprising:

a hydraulic lash adjuster assembly, comprising a body portion having a closed bore formed therein;

a plunger slidingly received within said bore, said plunger having a top surface;

a high pressure chamber formed in said lash adjuster assembly;

a valve opening formed in said body portion permitting engine fluid to flow from an engine fluid supply to said high pressure chamber;

a check valve mechanism for selectively opening or closing said valve opening in response to pressure differences between said engine fluid supply and said high pressure chamber; and a bleed hole formed through said plunger in communication with said top surface of said plunger allowing engine fluid to leak out therethrough;

a cam follower having a cup formed therein for communicating with said top surface of said plunger; and a cam for applying variable force to said cam follower;

whereby during said valve lift event said cam follower applies force to said bleed hole reducing the thickness of the engine fluid film flowing therethrough and reducing the leak down rate; and whereby when said cam is on base circle the film thickness between said cam follower and said plunger will increase thus increasing the leak rate of engine fluid through said bleed hole.

15. The system of claim 14 wherein said bore has a seal positioned therein preventing engine fluid from flowing from said high pressure chamber out of said lash adjuster through said bore.

16. The system of claim 14, wherein said check valve mechanism, includes a ball valve biased into communication with said valve opening by a first spring member, and further includes a platform member for supporting said first spring member.

17. The system of claim 16, further comprising a plunger spring located in said high pressure chamber for biasing said plunger outward and supporting said platform member.

* * * * *